US005713520A

United States Patent [19]

Glassey et al.

[11] Patent Number: 5,713,520

[45] Date of Patent: Feb. 3, 1998

[54] FAST SPILL DEVICE FOR ABRUPTLY ENDING INJECTION IN A HYDRAULICALLY ACTUATED FUEL INJECTOR

[75] Inventors: Stephen F. Glassey, East Peoria; Richard H. Holtman, Dunlap, both of Ill.

[73] Assignee: Caterpillar Inc., Peoria, Ill.

[21] Appl. No.: 562,971

[22] Filed: Nov. 27, 1995

[51] Int. Cl.[6] ..... F02M 47/02

[52] U.S. Cl. ..... 239/92; 239/124

[58] Field of Search ..... 239/88–92, 533.3–533.12, 239/585.1–585.5, 124

[56] References Cited

U.S. PATENT DOCUMENTS

| | | | |
|---|---|---|---|
| 2,279,010 | 4/1942 | Nichols | 123/139 |
| 2,985,378 | 5/1961 | Falberg | 239/96 |
| 3,083,912 | 4/1963 | Shallenberg | 239/88 |
| 3,379,374 | 4/1968 | Mekkes | 239/90 |
| 4,034,914 | 7/1977 | Richter | 239/96 |
| 4,279,385 | 7/1981 | Straubel et al. | 239/90 |
| 4,544,096 | 10/1985 | Burnett | 239/92 |
| 4,946,106 | 8/1990 | Turchi et al. | 239/533.8 |
| 5,056,488 | 10/1991 | Eckert | 123/446 |
| 5,160,088 | 11/1992 | Weiss et al. | 239/88 |
| 5,505,384 | 4/1996 | Camplin | 239/92 X |
| 5,522,545 | 6/1996 | Canplin et al. | 239/92 |
| 5,544,815 | 8/1996 | Cooke et al. | 239/533.8 |

FOREIGN PATENT DOCUMENTS

| | | | |
|---|---|---|---|
| 1233381 | 5/0000 | France | 239/92 |

*Primary Examiner*—Kevin Weldon
*Attorney, Agent, or Firm*—Liell & McNeil

[57] ABSTRACT

In a hydraulically actuated fuel injector, each injection event is initiated and terminated by opening an actuation fluid cavity within the injector to a high pressure inlet source and a low pressure drain, respectively. The present invention is intended to provide a more abrupt ending to each injection event in order to improve performance and exhaust emission quality. The present invention incorporates a hydraulically actuated spill valve into the injector body. The spill valve exploits the pressure differential existing between the fuel pressurization chamber of the injector toward the end of each injection and the drop in pressure in the actuation fluid cavity. This pressure differential is exploited to hydraulically open a spill port to allow the residual fuel pressure to dissipate into a fuel return passage rather than dribble out of the injector nozzle while the needle check is moving toward its closed position.

6 Claims, 4 Drawing Sheets

12
9
14
32
28
15
33
30
11
61
60
66
64
51
68
24
18
26
19
70
71
9
22
21
20
72
67
25
17
59
65
69
16
13
50
62
52
9
10

FAST SPILL DEVICE FOR ABRUPTLY ENDING INJECTION IN A HYDRAULICALLY ACTUATED FUEL INJECTOR

TECHNICAL FIELD

The present invention relates generally to hydraulically actuated fuel injectors, and in particular to a fast spill device for abruptly terminating injection in a hydraulically actuated fuel injector.

BACKGROUND ART

Over the years engineers have recognized that the mass flow profiles of fuel injectors have a strong influence on the performance of the engine and the quality of exhaust from the engine. For example, it has been found that providing an abrupt end to injection mass flow results in a reduction in smoke and particulate matter in the exhaust from the engine, particularly at high speeds and low load conditions. In the case of VOP (valve opening pressure) type fuel injectors having a biased needle check that opens and closes the nozzle, a more abrupt ending to injection can be accomplished by hastening the rate at which the needle check closes and/or by decreasing the fuel pressure present while the needle check is open but moving toward its closed position.

In the case of prior art hydraulically actuated electronically controlled fuel injectors (HEUI) such as those manufactured by Caterpillar, each injection event is initiated and terminated by energization and de-energization, respectively, of a solenoid actuated control valve. Energizing the solenoid allows high pressure actuation fluid to flow into the injector and act upon an intensifier piston in a manner known in the art. The piston begins its downward stroke in conjunction with a plunger that quickly raises fuel pressure in a pressurization chamber to a magnitude sufficient to raise the needle check to open the injector nozzle. Each injection event is ended by de-activating the solenoid to open the actuation fluid cavity to a low pressure drain. This in turn ceases the downward movement of the piston/plunger resulting in a drop in fuel pressure. Eventually, as fuel pressure dissipates, the needle check begins to move toward its closed position. Unfortunately, the residual fuel pressure tends to slow the closure rate of the needle check. Also, residual fuel pressure causes fuel at a relatively lower pressure to be sprayed out the nozzle outlet as the needle check returns to its closed position. The present invention is directed to providing a more abrupt end to injection in hydraulically actuated fuel injectors in order to improve engine performance and exhaust quality.

DISCLOSURE OF THE INVENTION

In one embodiment of the present invention, a hydraulically actuated fuel injector is provided with an injector body having an actuation fluid cavity that opens to an actuation fluid inlet, an actuation fluid drain, and a piston bore. The injector body also includes a plunger bore that opens to a nozzle supply bore and a fuel supply passage, and includes a nozzle chamber that opens to the nozzle supply passage and a nozzle outlet. A control valve is mounted within the injector body and is moveable between a first position that opens the actuation fluid inlet and closes the actuation fluid drain, and a second position that closes the actuation fluid inlet and opens the actuation fluid drain. An intensifier piston is positioned to reciprocate in the piston bore between an upper position and a lower position. A plunger having an axis, and a pressure face separated from the contact end by a side surface is positioned to reciprocate in the plunger bore between an advanced position and a retracted position. A portion of the plunger bore and the pressure face end of the plunger define the fuel pressurization chamber that opens to the nozzle supply passage and the fuel supply passage. A check valve is positioned in the fuel supply passage and is operable to prevent flow of fuel from the fuel pressurization chamber back into the fuel supply passage. A needle check is positioned to reciprocate in the nozzle chamber between a closed position that closes the nozzle outlet and an open position that opens the nozzle outlet. The needle check includes a hydraulic lift surface exposed to a nozzle chamber and means for biasing the needle check toward its closed position.

The injector includes a hydraulically actuated spill valve having an upper hydraulic surface area exposed to pressure within the actuation fluid cavity and a lower hydraulic surface area exposed to pressure within the fuel pressurization chamber. The spill valve is moveable within the injector body between a spill position that opens the fuel pressurization chamber to a low pressure fuel return passage and a closed position that closes the fuel pressurization chamber to the low pressure fuel return passage.

At the end of each injection event, the high pressure in the actuation fluid cavity is abruptly lowered by opening the cavity to a low pressure actuation fluid drain. In the preferred embodiment of the present invention, this is accomplished by utilizing a solenoid actuated control valve. This abrupt change in relative pressure between the actuation fluid cavity and the fuel pressurization chamber is exploited in the present invention to hydraulically open the fuel pressurization chamber to a low pressure fuel return passage. This serves to quickly dissipate residual fuel pressure acting on the needle check. The end result being that the needle check closes faster than it otherwise would, and less residual fuel exits the nozzle while the needle check is in the process of closing. This more abrupt ending to each injection event results in a reduction of smoke and other particulate matter in the exhaust.

One object of the present invention is to provide a more abrupt end to each injection event for hydraulically actuated fuel injectors.

Another object of the present invention is to exploit pressure differentials within the fuel injector as a means by which residual fuel pressure can be vented at the end of each injection event.

Still another object of the present invention is to improve the quality of emissions from internal combustion engines utilizing fuel injectors.

Another object of the present invention is to provide an improved hydraulically actuated fuel injector.

BEST MODE FOR CARRYING OUT THE INVENTION

Figure 1:
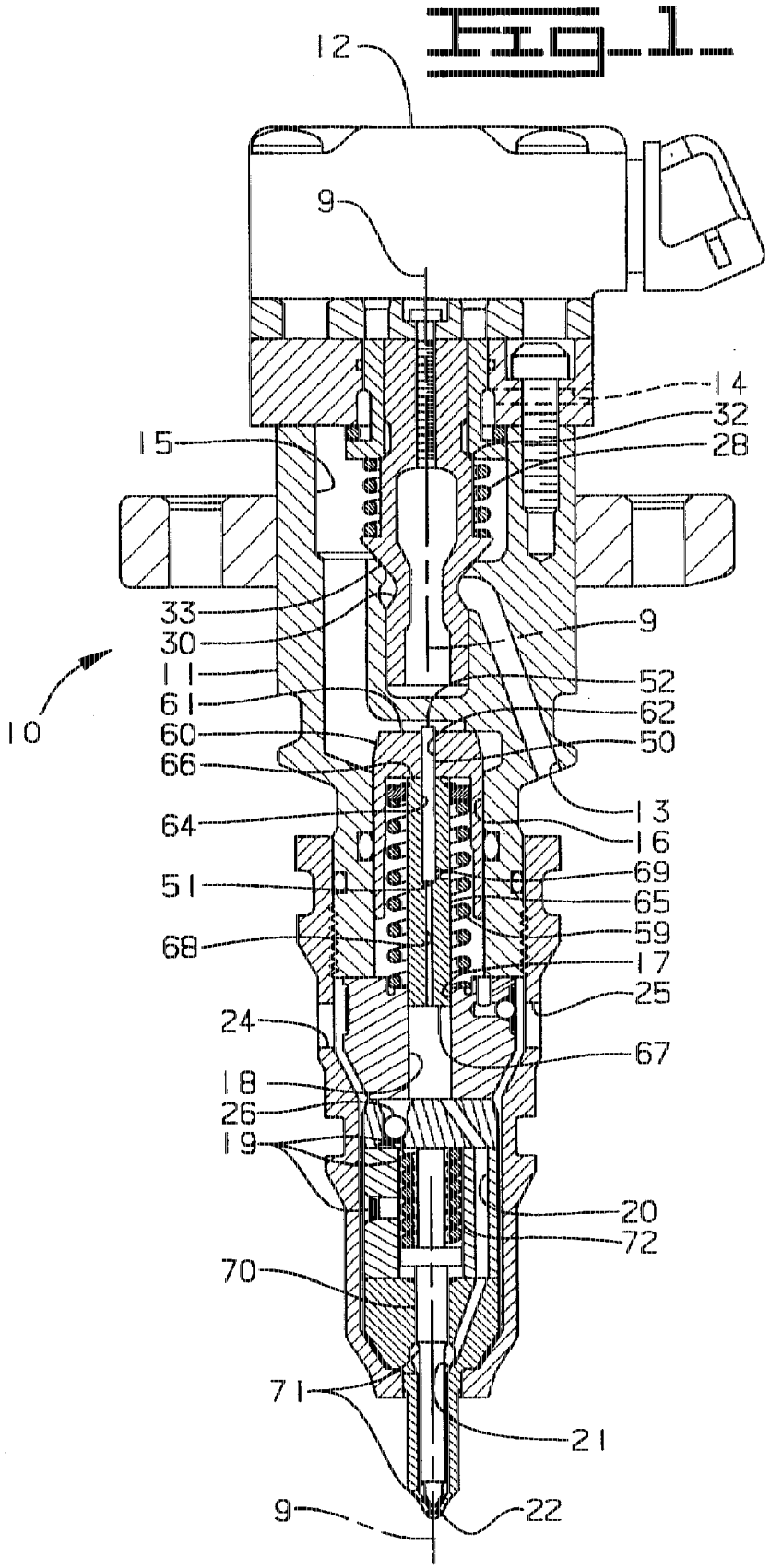
FIG. 1 is a side sectioned elevational view of a HEUI type fuel injector according to the preferred embodiment of the present invention.
Figure 2:
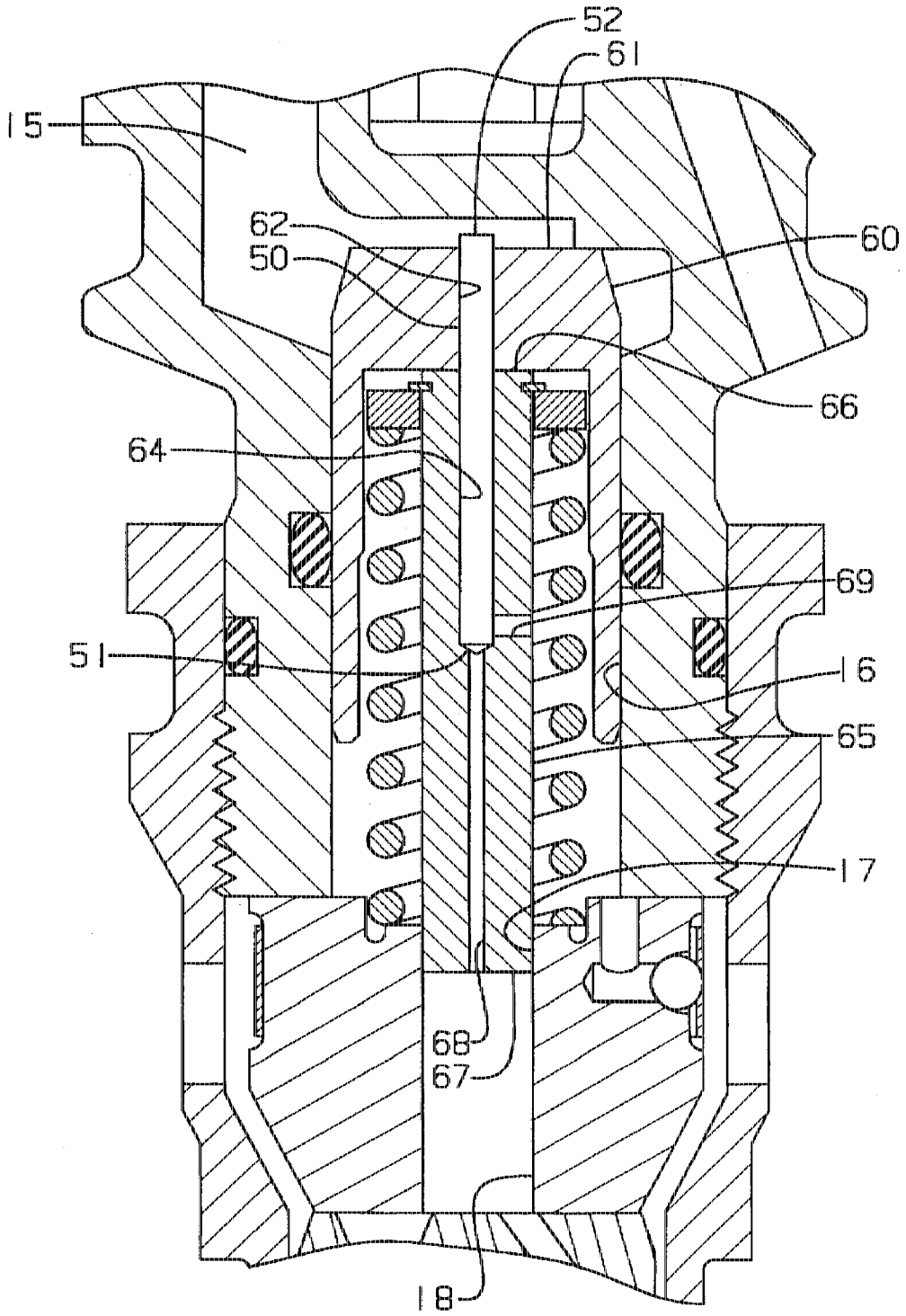
FIG. 2 is an enlarged side sectional view of the plunger/piston assembly of the injector of claim 1 showing the spill valve in its closed position.

Referring now to FIG. 1, a hydraulically actuated electronically controlled fuel injector 10 is structurally similar to prior art injectors of its type except for the inclusion of a spill valve 50 that allows fuel pressure at the end of each injection event to be vented to a return line instead of "dripping" out of the nozzle outlet. Most of the key components of injector 10 are centered around an axis 9. Although those skilled in the art are familiar with the various components and functioning of the injector 10, a brief review of injector 10's internal structure will aid those skilled in the art in appreciating the advantages of the present invention, at least as it relates to hydraulically actuated fuel injectors.

Figure 3:
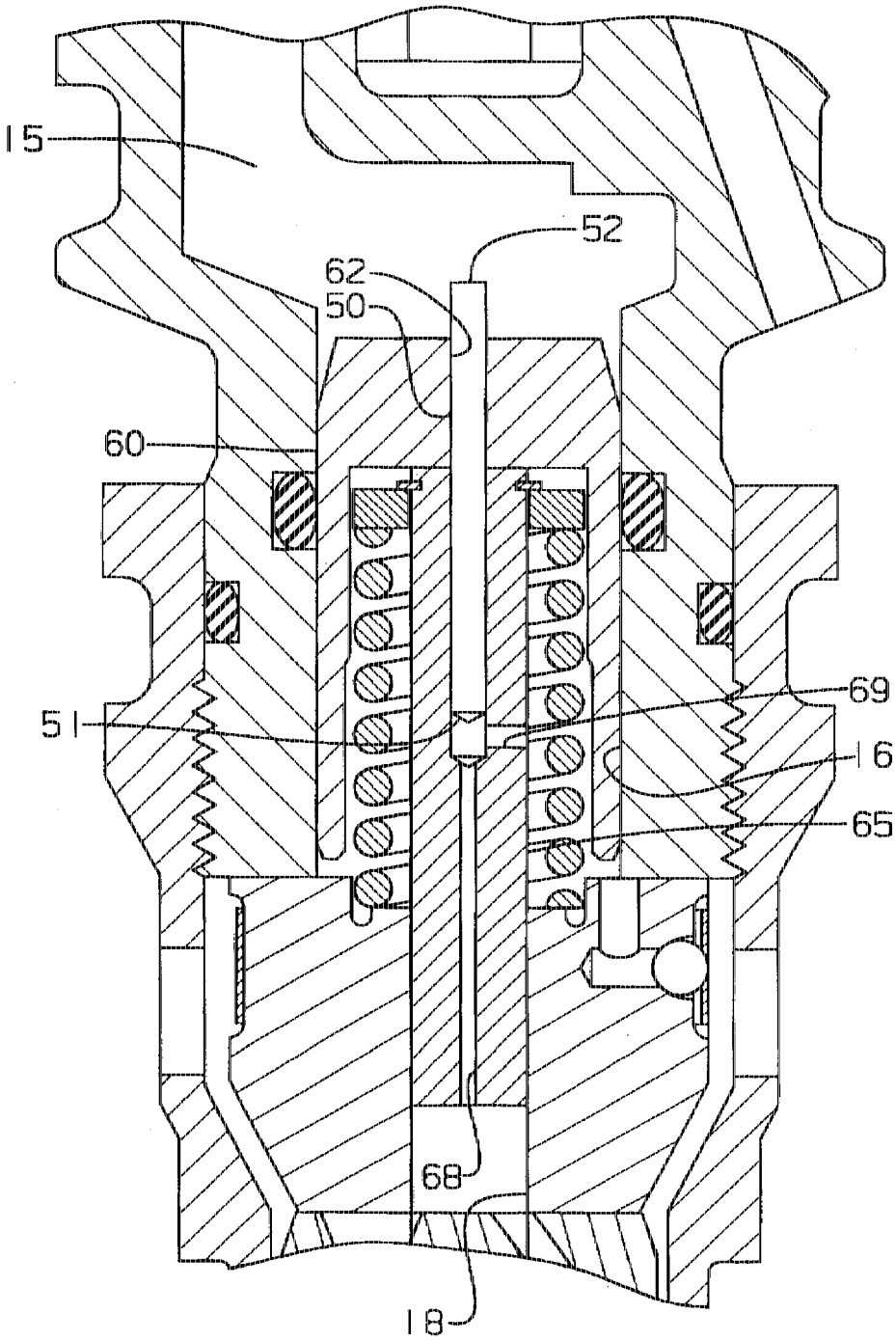
FIG. 3 is an enlarged side sectional view of the plunger/piston assembly of the injector of FIG. 1 at the end of an injection event with the spill valve in its open position.

Injector 10 includes an injector body 11 made from several joined blocks machined with various internal passageways in a manner known in the art. In particular, the injector body 11 includes an actuation fluid cavity 15 that opens to an actuation fluid inlet 13, an actuation fluid drain 14 (hidden in this sectioned view) and a piston bore 16. The injector body also defines a plunger bore 17 that opens to a nozzle supply bore 20 and a fuel supply passage 19. Finally, the injector body defines a nozzle chamber 21 that opens to nozzle supply bore 20 and a nozzle outlet 22. An intensifier piston 60 is positioned to reciprocate in piston bore 16 between an upper position (as shown) and a lower position (see FIG. 3). A plunger 65 having a contact end 66 and pressure face end 67 is positioned to reciprocate in plunger bore 17 between an advanced position (see FIG. 3) and a return position (as shown). A portion of the plunger bore and the pressure face end 67 of the plunger define a fuel pressurization chamber 18. A one way valve 26 is positioned in the fuel supply passage 19 and is operable to prevent fluid flow from fuel pressurization chamber 18 into fuel supply passage 19.

A needle check 70 is positioned to reciprocate in nozzle chamber 21 between a closed position that closes nozzle outlet 22 and an open position that opens the nozzle outlet. The needle check includes a hydraulic lift surface 71 exposed to nozzle chamber 21 and means, such as coil spring 72, for biasing the needle check 70 toward its closed position. A solenoid housing 12 is attached to the top of injector body 11 and includes an electromagnetic coil (not shown) and an armature 41 that moves when the electromagnetic coil is activated with electric current. Armature 41 is connected to a valve member 30 via a screw so that valve member 30 moves with the armature in order to open and close actuation fluid inlet 13 and actuation fluid drain 14. In this embodiment, return spring 28 biases valve member 30 to a lower position in which valve seat 33 closes actuation fluid inlet 13 when the solenoid is deactivated.

An injection event is initiated by energizing the solenoid to lift valve member 30 off its lower seat so that high pressure hydraulic actuation fluid flows into actuation fluid cavity 15. The high pressure hydraulic actuation fluid in cavity 15 acts on the top surface 61 of intensifier piston 60 and begins pushing the intensifier piston toward its lower position. Movement of intensifier piston 60 simultaneously causes plunger 65 to move downward towards its advanced position because of the contact between the piston and the plunger. Downward movement of plunger 65 in turn raises fuel pressure within fuel pressurization chamber 18. When fuel pressure in pressurization chamber 18, nozzle supply passage 20 and nozzle chamber 21 reaches a threshold pressure sufficient to overcome biasing spring 72, needle check 70 lifts and nozzle outlet 22 is opened. Each injection event ends by de-energizing the solenoid to close actuation fluid inlet 13, which simultaneously opens actuation fluid cavity 15 to the low pressure actuation fluid drain 14. In between injection events, fuel flows into injector body 11 through fuel inlet 24 along fuel supply passage 19 past one way valve 26 and into fuel pressurization chamber 18 as plunger 65 and piston 60 retract in preparation for the next injection event. Fuel entering inlet 24 is free to circulate to fuel outlet 25 so that various injectors for a multi cylinder engine can be connected serially to a fuel supply source in a manner known in the art.

The plunger and piston are able to retract between injection events because actuation fluid in actuation fluid cavity 15 is allowed to escape through to a low pressure actuation fluid drain 14. In other words, the passage past upper valve seat 32 of valve member 30 is open when the solenoid is de-energized. When the solenoid is energized, valve member 30 is lifted a distance on the order of about 250 microns which is sufficient to close the low pressure actuation fluid drain 14 while simultaneously opening the high pressure actuation fluid inlet 13 to cavity 15.

When each injection event ends by the de-energization of the solenoid, pressure in actuation fluid cavity 15 quickly drops. This drop in turn causes the intensifier piston 60 and plunger 65 to cease their downward movement. Pressure within the fuel pressurization chamber 18 and nozzle chamber 21 begins to drop to a point that the pressure is no longer able to overcome the closing force of biasing spring 72. The needle check 70 begins to close. The present invention is primarily concerned with that time period that begins with the de-energization of the solenoid and ends with the actual closure of nozzle outlet 22. It has been found that relatively low pressure fuel exiting the nozzle outlet during this time period causes an undesirable increase in smoke and particulate matter, particularly at high speed/low load conditions. The present invention is directed to making this time period as short as possible.

In order to do so, plunger 65 is provided with a spill passage 68 that opens at one end through pressure face end 67 and opens through the side surface of the piston through spill opening 69. A spill valve member 50 is positioned to reciprocate in a valve bore 62 in intensifier piston 60 and a valve bore 64 in plunger 65. Spill valve member 50 is hydraulically actuated such that its upper hydraulic surface 52 is exposed to the pressure within actuation fluid cavity 15, whereas the area on its lower hydraulic surface 51 is exposed to the pressure within fuel pressurization chamber 18 via a portion of spill passage 68. The respective exposed surface areas of upper hydraulic surface 52 and lower hydraulic surface 51 are chosen such that valve member 50 closes spill opening 69 whenever actuation fluid cavity 15 is at a relatively high pressure as during an injection event. However, the areas are chosen such that when pressure in fuel pressurization chamber 18 is relatively high but pressure within fluid actuation cavity 15 is dropping below a threshold, the valve member 50 will move upward and open spill passage 68 to spill opening 69. As can be discerned from FIG. 4, the hydraulically actuated spill valve must have the ability to open in a fraction of a millisecond in order to provide an abrupt end to injection.

Although valve member 50 could be provided with some means, such as a spring to bias it closed, hydraulic forces acting on the respective ends 51 and 52 of valve member 50 should cause it to automatically close when the plunger 65 and piston 60 begin retracting in preparation for the next injection event. When the piston/plunger begins retracting, a vacuum is created within fuel pressurization chamber 18.

This along with the residual pressure in fluid actuation cavity 15 causes spill valve member 50 to quickly close shortly after the injection event has ended. Thus, those skilled in the art will appreciate that spill valve member 50 is closed over the majority of each injection cycle, but is open during that brief period from the time that solenoid actuated control valve 30 opens drain 14 until the time that needle check 70 closes nozzle outlet 22. Spill opening 69 opens into the lower portion of piston bore 16, which holds return spring 59. This cavity is in turn opened to fuel return opening 25 via a passage past check valve 29.

Figure 4:
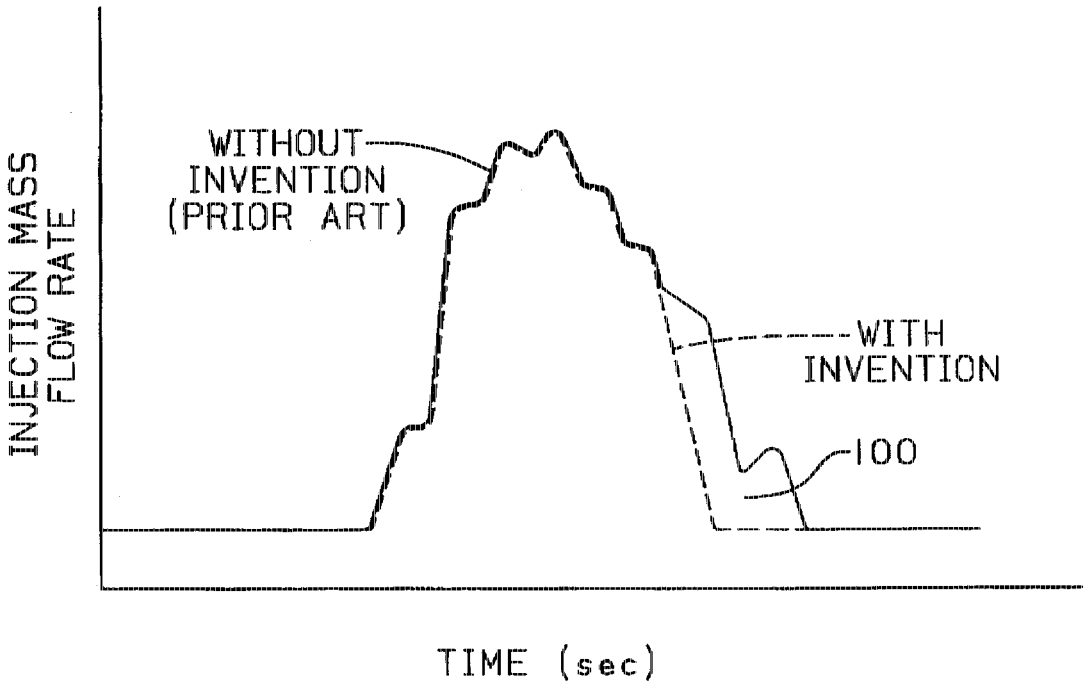
FIG. 4 is a graph of injection mass flow rate versus time over a single injector cycle with and without the spill valve of the present invention.

Referring now to FIG. 4, a profile of injection mass flow rate out of nozzle 22 is shown for a single injector cycle with and without the hydraulically actuated spill valve of the present invention. As can be seen, the opening of the spill valve toward the end of each injection event causes the injection event to end far more abruptly than that of the prior art fuel injector. The residual fuel 100 which would otherwise have left the nozzle at a relatively low pressure is instead vented through fuel spill passage 68 and eventually into fuel return passage 25 to be recirculated. Although the hydraulically actuated spill valve of the present invention has been shown incorporated along the centerline of the fuel injector through the plunger and intensifier piston, those skilled in the art will appreciate that a hydraulically actuated spill valve according to the present invention could be machined into injector body 11 apart from the intensifier piston/plunger assembly. However, incorporation of the hydraulically actuated spill valve into the plunger/piston assembly is preferred because the ease of manufacturing.

Industrial Applicability

The present invention finds application particularly in the field of hydraulically actuated fuel injectors. Although the present invention could find potential application in any fuel injector utilizing a high pressure fluid to work upon an intensifier piston. The principles of the present invention can be utilized in fuel injectors in which each injection event is terminated by dropping fluid pressure acting upon the intensifier piston. This drop in actuation fluid pressure combined with the residual fuel pressure in the fuel within the nozzle chamber can be exploited under the teachings of the present invention to vent that residual fuel pressure to a return line instead of allowing the fuel to "drip" out of the nozzle while the needle check moves toward its closed position. Needle check 70 is allowed to closed much more rapidly because of the present invention not only relieves residual hydraulic pressure acting to resist closure of the needle check but also because the residual fuel itself is allowed to vent to a return line rather than out of the nozzle outlet as the needle check moves toward its closed position.

The above description is intended for illustrative purposes only. Those skilled in the art will appreciate that the pressure spilling concepts provided by the present invention could be incorporated into fuel injectors having a wide variety of structures and functioning concepts. In any event, the scope of the present invention is not intended to be limited in any way by the illustrated example described previously but solely in terms of the claims set forth below.

We claim:

1. A hydraulically actuated fuel injector comprising:

an injector body having an actuation fluid cavity that opens to actuation fluid inlet, an actuation fluid drain and a piston bore, and having a plunger bore that opens to a nozzle chamber and a fuel supply passage, and said nozzle chamber opens to a nozzle outlet;

a control valve mounted in said injector body and being movable between a first position that opens said actuation fluid inlet and closes said actuation fluid drain, and a second position that closes said actuation fluid inlet and opens said actuation fluid drain;

an intensifier piston positioned to reciprocate in said piston bore between an upper position and a lower position;

a plunger having an axis, a pressure face end separated from a contact end by a side surface, and being positioned to reciprocate in said plunger bore between an advanced position and a retracted position;

a portion of said plunger bore and said pressure face end of said plunger defining a fuel pressurization chamber that opens to said nozzle chamber and said fuel supply passage;

a check valve positioned in said fuel supply passage and being operable to prevent flow of fuel from said fuel pressurization chamber back into said fuel supply passage;

a needle check positioned to reciprocate in said nozzle chamber between a closed position that closes said nozzle outlet and an open position that opens said nozzle outlet, said needle check including a hydraulic lift surface exposed to said nozzle chamber;

means, within said injector body, for biasing said needle check toward said closed position; and a hydraulically actuated spill valve having an upper hydraulic surface area exposed to pressure within said actuation fluid cavity and a lower hydraulic surface area exposed to pressure within said fuel pressurization chamber, and being moveable within said injector body between a spill position that opens said fuel pressurization chamber to a low pressure fuel return passage and a closed position that closes said fuel pressurization chamber to said low pressure fuel return passage.

2. The fuel injector of claim 1 wherein said hydraulically actuated spill valve includes a spill valve member with said upper hydraulic surface area on one end and said lower hydraulic surface area on its opposite end;

said spill valve member moves to said spill position when the force acting on said upper hydraulic surface area is less than the force acting on said lower hydraulic surface area; and said spill valve member moves to said closed position when the force acting on said lower hydraulic surface area is less than the force acting on said upper hydraulic surface area.

3. The fuel injector of claim 2, wherein said hydraulically actuated spill valve includes:

said plunger having a spill passage extending from said pressure face end toward said contact end, and a spill port opening extending between said spill passage and said low pressure fuel return passage;

said intensifier piston having a spill valve bore opening extending between said actuation fluid cavity and said spill passage; and said spill valve member being positioned to reciprocate in said spill valve bore and a portion of said spill passage between said spill position that opens said spill port and said closed position that closes said spill port.

4. The fuel injector of claim 3 further comprising means for limiting the distance said spill valve member can reciprocate.

5. The fuel injector of claim 1 wherein said hydraulically actuated spill valve is biased toward one of either said spill position or said closed position.

6. The fuel injector of claim 1 further comprising a solenoid mounted to said injector body and having an armature attached to said control valve; and energization of said solenoid moves said control valve from said second position to said first position.

* * * * *